US011006206B2

(12) United States Patent
Morris et al.

(10) Patent No.: US 11,006,206 B2
(45) Date of Patent: May 11, 2021

(54) ERGONOMIC HEADPHONE DEVICE

(71) Applicant: Microsoft Technology Licensing, LLC, Redmond, WA (US)

(72) Inventors: John Richard Morris, Bothell, WA (US); Daniel Anton Ruud Dhondt, Sammamish, WA (US); Alexander Norman Bennett, Seattle, WA (US); Ryan Alain Laprise, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/434,735

(22) Filed: Jun. 7, 2019

(65) Prior Publication Data

US 2020/0389719 A1 Dec. 10, 2020

(51) Int. Cl.
*H04R 1/10* (2006.01)

(52) U.S. Cl.
CPC ..... *H04R 1/1091* (2013.01)

(58) Field of Classification Search
CPC combination set(s) only.
See application file for complete search history.

(56) References Cited

U.S. PATENT DOCUMENTS 4,027,113 A 5/1977 Matsumoto et al.
5,109,424 A * 4/1992 Andre ..... H04R 1/1008 381/371
5,862,241 A 1/1999 Nelson
7,171,698 B2 2/2007 Saffran
8,213,667 B2 * 7/2012 Nelson ..... F16C 11/06 381/378
9,344,794 B1 * 5/2016 Blonder ..... H04R 1/1066
10,362,399 B1 * 7/2019 Carino ..... H04R 5/033
2004/0216946 A1 11/2004 Lenhard-Backhaus
2009/0268936 A1 * 10/2009 Goldberg ..... H04R 1/1041 381/384
2010/0034414 A1 2/2010 Miyata
2014/0205129 A1 * 7/2014 Blair ..... H04R 5/0335 381/378

(Continued)

FOREIGN PATENT DOCUMENTS

DE 202014104081 U1 9/2014
GB 1347824 A 2/1974

(Continued)

OTHER PUBLICATIONS

WO/2018/066071, Dec. 4, 2018, Headphone, Fukushima, English translation of WIPO WO2018/066071A1, 23 pages (Year: 2018).*

(Continued)

*Primary Examiner* — Duc Nguyen
*Assistant Examiner* — Assad Mohammed
(74) *Attorney, Agent, or Firm* — Wade IP Law PLLC

(57) ABSTRACT

A headphone device having a listening configuration and a storage configuration. In the listening configuration, the headphone device is configured to provide an ergonomic fit for a user when the headphone device is worn on the user's head with earcups oriented over the user's ears. In the storage configuration, the headphone device is configured to provide an ergonomic fit for the user when the headphone device is worn around the user's neck.

20 Claims, 6 Drawing Sheets

(56) References Cited

U.S. PATENT DOCUMENTS

| | | | | |
|---|---|---|---|---|
| 2014/0254853 | A1 | 9/2014 | Blonder et al. | |
| 2015/0139473 | A1 | 5/2015 | Jaynes | |
| 2016/0193085 | A1 | 7/2016 | Jenkins et al. | |
| 2017/0041697 | A1* | 2/2017 | Levine | H04R 1/1033 |
| 2017/0257693 | A1* | 9/2017 | Breen | H04R 1/1008 |
| 2017/0264992 | A1* | 9/2017 | Wallace | H04R 1/1066 |
| 2018/0220224 | A1* | 8/2018 | Chute | H04R 1/105 |

FOREIGN PATENT DOCUMENTS

| | | | | |
|---|---|---|---|---|
| JP | 2013158038 | A | 8/2013 | |
| WO | WO-2018066071 | A1 * | 4/2018 | H04R 1/1041 |

OTHER PUBLICATIONS

"Active Noise Cancelling Bluetooth Headphones, iDeaUSA Wireless Headphones with Microphones Over Ear Headphones with aptX HiFi Stereo Sound 25 Hours Playback—Black", Retrieved From: https://www.amazon.in/Cancelling-Bluetooth-Headphones-iDeaUSA-Microphones/dp/B01N1RV1XY, Retrieved Date: May 23, 2019, 7 Pages.

"Akg K451 Supra Aural Folding Headphones with Pivoting Earcups!", Retrieved From: http://www.gadgetexplained.com/2016/07/akg-k451-supra-aural-folding-headphones.html, Jul. 6, 2016, 6 Pages.

"International Search Report and Written Opinion Issued in PCT Application No. PCT/US20/030333", dated Jul. 21, 2020, 9 Pages.

* cited by examiner

ERGONOMIC HEADPHONE DEVICE

BACKGROUND

Headphone devices are often used to privately listen to an audio signal such as music, or to conduct a conversation. When listening to an audio signal or conducting a conversation, a user typically wears the headphone device so that speakers included in the headphone device are positioned over the user's ears. When the headphone device is not in use, a user often continues to wear the headphone device, but in a location away from the user's ears rather than completely removing the headphone device. For instance, when the headphone device is not in use, the user may wear the headphone device around the user's neck.

SUMMARY

Various approaches are described herein for, among other things, providing a construction for an ergonomic headphone device. For instance, a headphone device may be constructed to provide ergonomics that complement the user's neck and head when the headphone device is worn by the user and the device is in a listening configuration and in a storage configuration.

An example headphone device comprises a headband, a first earcup, and a second earcup. The first earcup is rotatably coupled to the headband about a first storage axis, and the first earcup is rotatable between a first listening orientation and a first storage orientation. The first storage orientation corresponds to an orientation of the first earcup rotated about the first storage axis that is in a range between −90° and 90° from the first listening orientation. The second earcup is rotatably coupled to the headband about a second storage axis, and the second earcup is rotatable between a second listening orientation and a second storage orientation. The second storage orientation corresponds to an orientation of the second earcup rotated about the second storage axis that is in a range of between −90° and 90° from the second listening orientation. A largest tangent clearance cylinder having a diameter of at least 4.75 inches is defined by the headband, the first earcup and the second earcup when the first earcup is in the first storage orientation and when the second earcup is in the second storage orientation.

A second example headphone device comprises a headband, a first earcup, and a second earcup. The first earcup is rotatably coupled to the headband and configured to rotate about a first storage axis between a first listening orientation and a first storage orientation. The first storage orientation of the first earcup corresponds to rotation of the first earcup about the first storage axis in a range between −90° and 90° from the first listening orientation. The second earcup is rotatably coupled to the headband and configured to rotate about a second storage axis between a second listening orientation and a second storage orientation. The second storage orientation of the second earcup corresponds to rotation of the second earcup about the second storage axis in a range between −90° and 90° from the second listening orientation. The first storage axis and the second storage axis define an XY plane, a center Y-axis is in the XY plane and interposed between the first earcup and the second earcup, and a YZ plane is perpendicular to the XY plane and includes the center Y-axis. A first earcup axis extends across a contact surface of the first earcup from an end of the first earcup adjacent the headband to an end of the first earcup spaced away from the headband. A second earcup axis extends across a contact surface of the second earcup from an end of the second earcup adjacent the headband to an end of the second earcup spaced away from the headband. A storage angle β between the center Y-axis on the YZ plane and a projection of the first earcup axis on the YZ plane when the first earcup is in the first storage orientation is in a range between 20° and 80°.

A third example headphone device comprises a headband, a first earcup, and a second earcup. The first earcup comprises a first yoke, and the first yoke is rotatably coupled to the headband at a first interface and configured to rotate around a first storage axis. The first yoke defines a first yoke axis. The second earcup comprises a second yoke, and the second yoke is rotatably coupled to the headband and configured to rotate about a second storage axis. The second yoke defines a second yoke axis. The first storage axis and the second storage axis define an XY plane. The headphone device defines a center Y-axis in the XY plane that is interposed between the first earcup and the second earcup. The first yoke axis is defined by a projection of a longitudinal axis of the first yoke onto the XY plane. The second yoke axis is defined by a projection of a longitudinal axis of the second yoke onto the XY plane. A yoke tilt angle δ between the first storage axis and the first yoke axis is in a range between 10° and 50°, and a yoke tilt angle δ between the second storage axis and the second yoke axis is in a range between 10° and 50°. A storage axis tilt angle α between the center Y-axis and the first storage axis is in a range between 0° and 20°, and a storage axis tilt angle α between the center Y-axis and the second storage axis is in a range between 0° and 20°.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Moreover, it is noted that the invention is not limited to the specific embodiments described in the Detailed Description and/or other sections of this document. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles involved and to enable a person skilled in the relevant art(s) to make and use the disclosed technologies.

Figure 1:
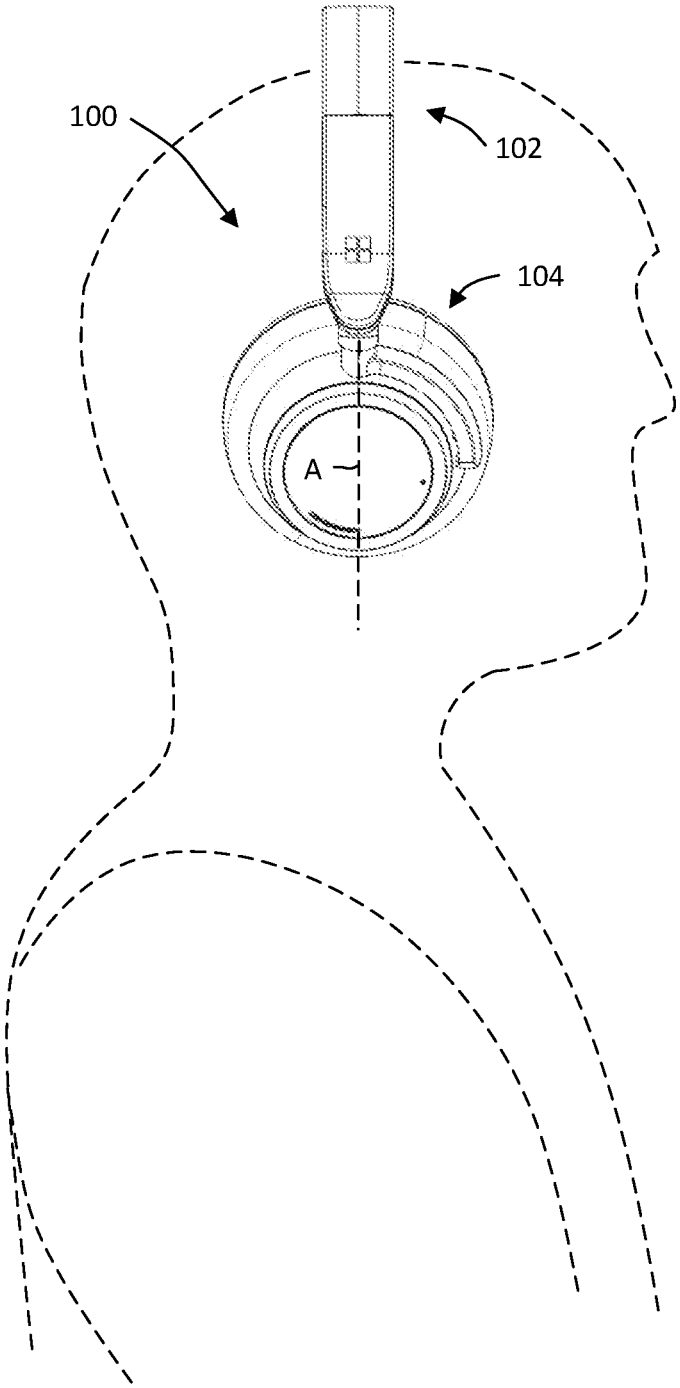
FIG. 1 is a side view of an example headphone device in a listening configuration on a user in accordance with an embodiment.

The features and advantages of the disclosed technologies will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

I. Introduction

The following detailed description refers to the accompanying drawings that illustrate example embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of one skilled in the relevant art(s) to implement such feature, structure, or characteristic in connection with other embodiments whether or not explicitly described.

II. Example Embodiments

Example embodiments described herein provide improvements over known headphone devices. Example embodiments of the headphone device include a construction that results in the headphone device matching the different ergonomics of the user when the headphone device is worn both on the user's head and around the user's neck. Example embodiments of the headphone device include a construction that increases an amount of clearance between a headband and earcups of the headphone device when the headphone device is worn around a user's neck. Example embodiments of the headphone device include a construction that more ergonomically matches the contours of the user's neck and shoulders.

FIG. 1 illustrates an example embodiment of a headphone device 100 in a listening configuration in accordance with an embodiment. In the listening configuration, the headband 102 and earcups, including a first earcup 104, are oriented to provide an ergonomic fit by complementing the ergonomics of the user's head and to position the earcups over the user's ears to provide optimal fit and sound. For example, the headphone device 100 is positioned so that a headband 102 extends over a user's head and the earcups are positioned over a user's ears so that an audible signal is directed toward the user's ears.

Figure 2:
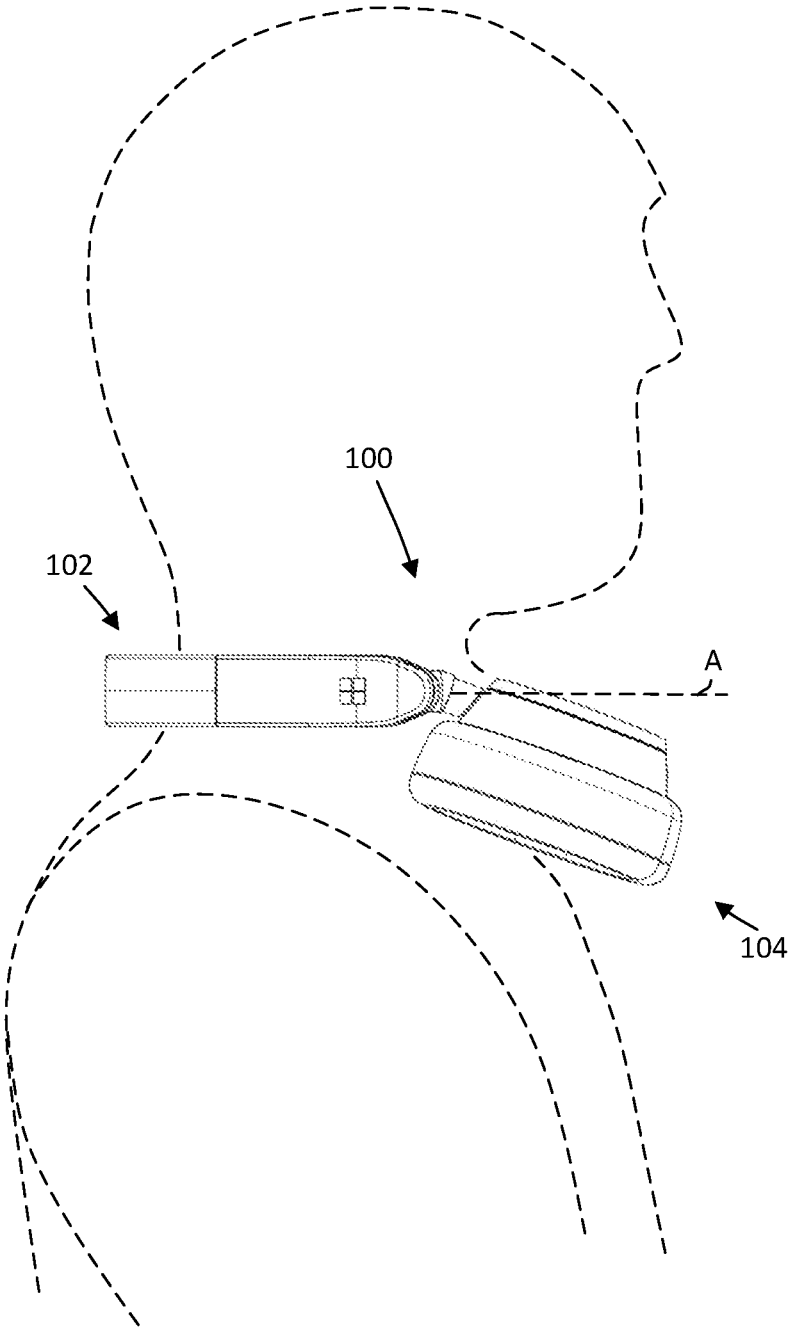
FIG. 2 is a side view of an example headphone device in a storage configuration on a user in accordance with an embodiment.

FIG. 2 illustrates an example embodiment of a headphone device 100 in a storage configuration in accordance with an embodiment. In the storage configuration, the headband 102 and earcups, including the first earcup 104, are oriented to provide an ergonomic fit by complementing the ergonomics of the user's neck and shoulders, and in at least some example embodiments to orient the earcups against the user's chest. For example, the headphone device 100 is positioned so that the headband 102 extends around the user's neck and the earcups are spaced to provide a clearance around the user's neck and angled downward toward the user's chest. The downward angle can be configured to provide clearance for the user to move their head and in some example embodiments to provide protection for speaker components included in the earcups. In an example embodiment, simply rotating the earcups relative to the headband transforms the configuration of the headphone device so that it can selectively complement the different ergonomics of the user's body in the listening configuration and in the storage configuration.

Figure 3:
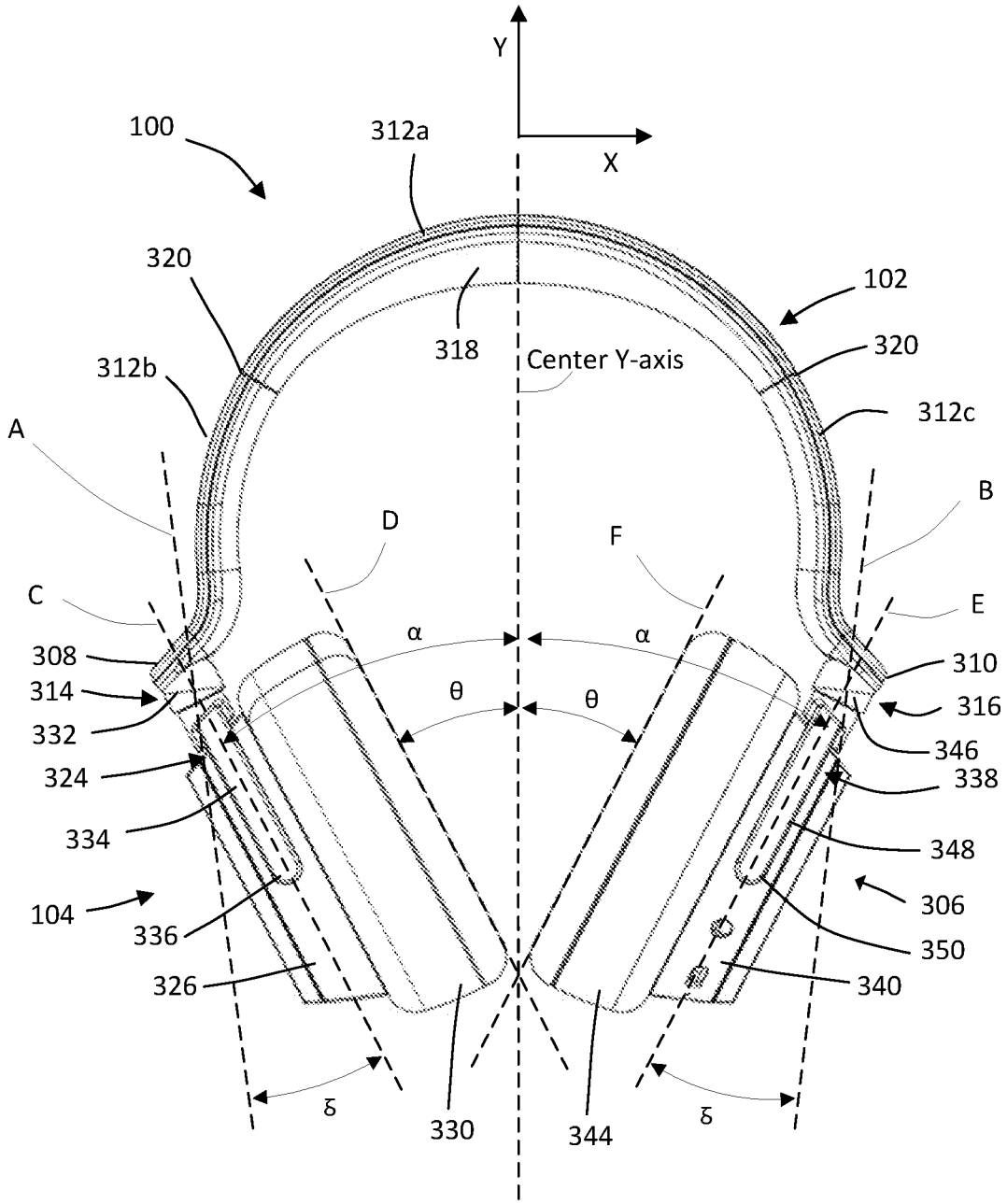
FIG. 3 is a front view of an example headphone device in a listening configuration in accordance with an embodiment.
Figure 4:
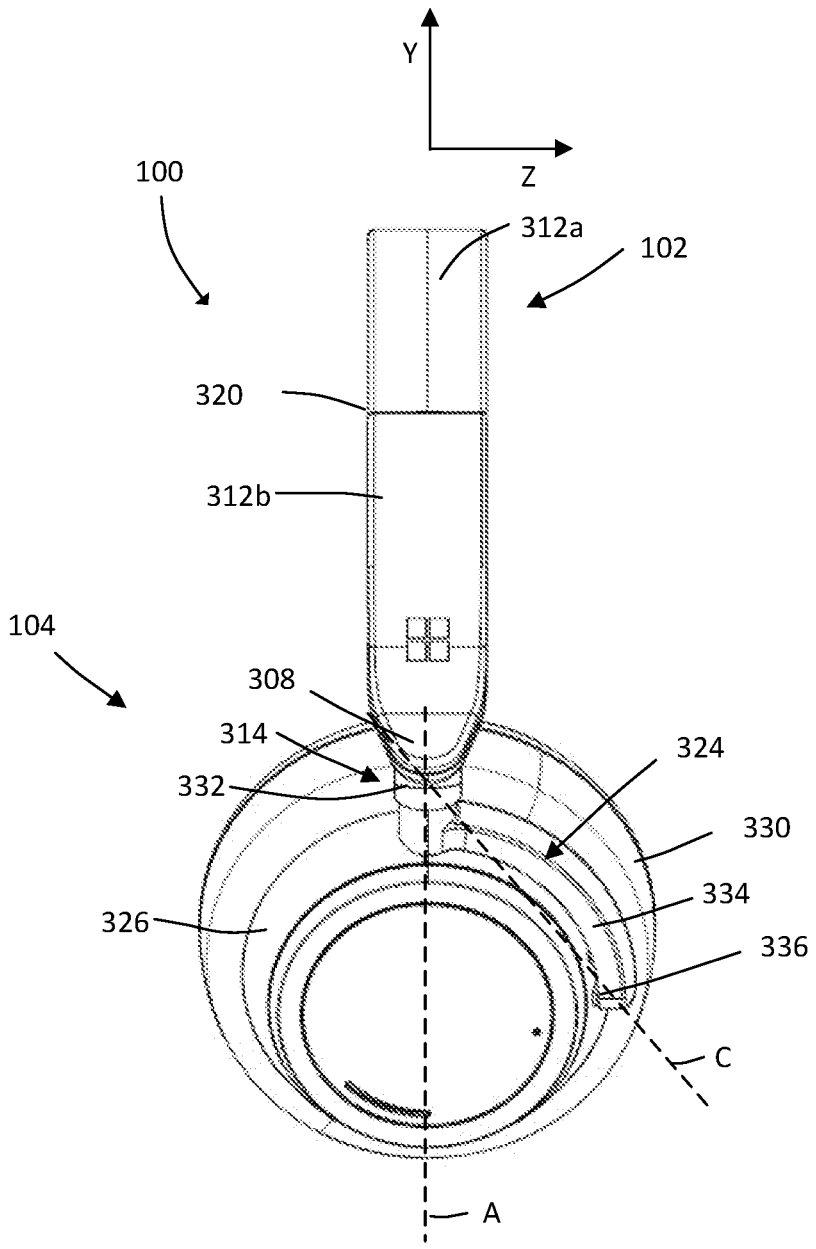
FIG. 4 is a side view of the example headphone device of FIG. 3 in the listening configuration in accordance with an embodiment.

Referring to FIGS. 3 and 4, the construction of the headphone device 100 will be described in greater detail in accordance with embodiments. A coordinate system oriented relative to the headphone device will be used to describe the attributes of the construction relative to the listening configuration and the storage configuration. The headphone device 100 is constructed from the headband 102, the first earcup 104, and a second earcup 306. The first earcup 104 is rotatably coupled to a first end 308 of the headband 102 at a first coupling 314 about a first storage axis A. The second earcup 306 is rotatably coupled to a second end 310 of the headband 102 at a second coupling 316 about a second storage axis B. In an example embodiment, the first storage axis A and the second storage axis B are co-planar and define an XY plane. A center Y-axis is disposed in the XY plane and is interposed between the first earcup 104 and the second earcup 306 so that the center Y-axis is equally spaced between the first earcup 104 and the second earcup 306. A YZ plane is perpendicular to the XY plane and positioned so that the YZ plane includes the center Y-axis. The storage axes A and B are angled relative to the center Y-axis by a storage axis tilt angle $\alpha$. In an example embodiment, the first storage axis A is angled relative to the center Y-axis by a storage axis tilt angle $\alpha$ in a range between 0° and 20°. In another example embodiment, the first storage axis A is angled relative to the center Y-axis by a storage axis tilt angle $\alpha$ in a range between 0° and 10°. In an example embodiment, the second storage axis B is angled relative to the center Y-axis by a storage axis tilt angle $\alpha$ in a range between 0° and 20°. In another example embodiment, the second storage axis B is angled relative to the center Y-axis by a storage axis tilt angle $\alpha$ in a range between 0° and 10°.

The first end 308 and the second end 310 of the headband 102 are spaced so that the first earcup 104 and the second earcup 306 are held in a spaced relationship from each other by the headband 102. When the headphone device 100 is configured in the listening configuration, as shown by FIGS. 1, 3, and 4, the spaced relationship between the first earcup 104 and the second earcup 306 places the earcups in a predefined location and orientation so that earcups can be positioned over a user's ears. In that position, the first earcup 104 and the second earcup 306 are configured to direct an audible signal toward the user's ears. Additionally, when the headphone device is in the listening configuration, each of the first earcup 104 and the second earcup 306 is in a listening orientation relative to the headband 102 in which the earcups are oriented to direct the audible signal laterally inward toward the YZ plane of the headphone device.

The headband 102 comprises an elongate body that is interposed between the first earcup 104 and the second earcup 306. In an example embodiment, the headband 102 is configured to rest on the top of a user's head, such as on the rearward portion of the user's frontal bone, on the forward portion of the user's parietal bone, and/or at a location where the front bone meets the parietal bone. It should be appreciated that the headband can be configured to rest over any portion of the user's head when the headphone device is in the listening configuration.

The headband 102 is configured to provide a desired fit of the headphone device 100 on the user. The shape and materials used in the construction of the headband 102 can be selected to provide the desired fit of the headphone device 100. In an example embodiment, the shape of the headband 102 is accurate and sized to correspond to the contour of a user's head. Additionally, the headband 102 can comprise a pad 318 that is oriented on an inner portion of the headband 102 so that the pad 318 is positioned to abut the user's head. In an example embodiment, the pad 318 is removeable so that it can be replaced by the user.

The headband 102 can also include at least a portion that is flexible. The flexible portion of the headband 102 forms a spring between the first earcup 104 and the second earcup 306. The head band 102 can be configured to provide a spring force that is selected so that the first earcup 104 and the second earcup 106 exert a predefined force on the sides of a user's head. In an example embodiment, the spring force is selected so that the predefined force results in the first earcup 104 and the second earcup 306 providing a seal against the user's head that reduces leakage of ambient noise past the earcups and into the user's ears. Additionally, the spring force can be selected to provide friction between the user's head and the earcups 104 and 306 to reduce relative motion between the user's head and the headphone device 100. In an example embodiment, the entire headband 102 is constructed to be flexible.

The headband 102 can also be configured to provide a desired fit by including a length adjustment feature. As an example, the headband 102 can comprise one or more telescoping joints 320 that permit a user to alter the length of the headband 102. In an example embodiment, the headband comprises a discontinuous elongate body that is constructed from a plurality of components, such as a crown member 312*a*, a first arm member 312*b*, and a second arm member 312*c*. The headband 102 can further comprise an extension member that extends across each discontinuity in the elongate body. The extension member can be slidably coupled across the discontinuity to at least one of the adjacent portions of the elongate body. Additionally, the extension member and/or the elongate body can comprise détente features to provide defined length settings and can provide audible and/or tactile feedback to a user while the user alters the length of the headband 102.

Additionally, the headband 102 can form a housing for electronics included in the headphone device 100. For example, the headband 102 can define a cavity that houses circuitry and a conduit for wiring included in the construction of the headphone device 100.

The first earcup 104 is rotatably coupled to the headband 102 at the first coupling 314, about the first storage axis A, so that the first earcup 104 can be rotated between a first listening orientation, shown in FIGS. 1, 3 and 4, and a first storage orientation, shown in FIGS. 2, and 5-7. The first earcup 104 can be coupled to the headband 102 so that the first earcup 104 can be rotated over any span. In an example embodiment, the first earcup 104 can rotate relative to the headband 102 in a span extending only between the first listening orientation and the first storage orientation, such as over a span of about 90°. In another example embodiment, the first earcup 104 can rotate relative to the headband 102 in a span up to 180°. In another example embodiment, the first earcup 104 can rotate relative to the headband 102 over a span that is greater than 180°. The first earcup 104 is constructed from a first yoke 324, a first earcup housing 326, a first speaker 628 (shown in FIG. 6), and a first earpad 330.

The first yoke 324 provides a linkage between the headband 102 and the first earcup housing 326. The first yoke 324 is coupled to the headband 102 at the first coupling 314 and to the first earcup housing 326 at a first housing coupling 336. The first yoke 324 is rotatably coupled to the headband 102 about the first storage axis A and configured to position the first earcup 104 in the first listening orientation and the first storage orientation based on the rotational position of the first yoke 324 relative to the headband 102. The first yoke 324 comprises a first coupling interface 332, a first yoke body 334, and the first housing coupling 336. The first yoke 324 defines a first yoke axis C, which is a projection of a longitudinal axis of the first yoke 324 that intersects the first storage axis A at the first coupling interface 332 and extends to the first housing coupling 336 onto the XY plane. The first yoke body 334 extends between the first coupling interface 332 and the first housing coupling 336 and may have any shape. In an example embodiment, the first yoke body 334 is an accurate member that curves around a portion of the first earcup housing 326. In an example embodiment, the first yoke 324 is rotatably coupled to the first earcup housing 326 at the first housing coupling 336 so that the first earcup 104 can be tilted to match the angle of the side of the user's head above and below the user's ear. In another example embodiment, the first yoke 324 can be configured to couple to the first earcup housing 326 at a plurality of spaced locations on the first earcup housing 326. In another example embodiment, the first yoke body 334 can be integrated into the first earcup housing 326.

The first earcup housing 326 provides a framework for supporting the components of the first earcup 104, such as the first speaker 628 and the first earpad 330. The first earcup housing 326 can also define a cavity to house electronics for the headphone device 100. Still further, the first earcup housing 326 can support control features that provide an interface for a user to alter settings of the headphone device 100. The control features can include buttons, switches, knobs, or any other control. Still further, the first earcup housing 326 can support indicator features, such as indicator lights and/or display screens, that provide visual feedback that is related a feature and/or a status of the headphone device 100. Additionally, the first earcup housing 326 includes a surface opposite the earpad 330 that can be used for control features, or as a support or mounting surface, and the surface can be planar.

The first speaker 628 is mounted in the first earcup housing 326 and is configured to generate an audible signal that is projected out of the first earcup 104. The first speaker 628 can be configured to receive a digital, or analog, audio input which the first speaker 628 then converts into the audible signal. In an example embodiment, the first speaker 628 includes a plurality of speakers that provide different audible signals and/or that direct audible signals in different directions.

The first earpad 330 is generally interposed between the first earcup housing 326 and a user's head when the headphone device 100 is worn in the listening configuration. The first earpad 330 is configured to provide both user comfort, such as by providing cushioning, and a seal that is selected to reduce ambient noise heard by the user. The first earpad 330 is coupled to the first earcup housing 326 and provides a contact surface of the first earcup 104. A first earcup axis D extends across the contact surface of the first earcup 104 from an end of the first earcup 104 adjacent the headband 102 to an end of the first earcup 104 spaced away from the headband 102. In relation to the user, when the user wears the headphone device 100 in the listening configuration, the first earcup axis D is oriented parallel to the side of the user's head in a direction from above the user's ear to below the user's ear. The earcup axis is angled relative to the center Y-axis by an earcup axis tilt angle θ. In an example embodiment, the first earcup axis D is angled relative to the center Y-axis by an earcup axis tilt angle θ that is in a range between 10° and 50°. In another example embodiment, the first earcup axis D is angled relative to the center Y-axis by an earcup axis tilt angle θ that is in a range between 20° and 40°.

The first earpad 330 can be an annular member that defines an opening that permits the first speaker 628 to project sound to the user's ear when the headphone device 100 is in the listening configuration and worn over the ears of a user. In an example embodiment, the opening defined by the first earpad 330 is large enough to fit the user's ear so that the earpad surrounds the user's ear. In an example embodiment, the first earpad 330 is removably coupled to the first earcup housing 326 so that the first earpad 330 can be replaced by the user.

Figure 5:
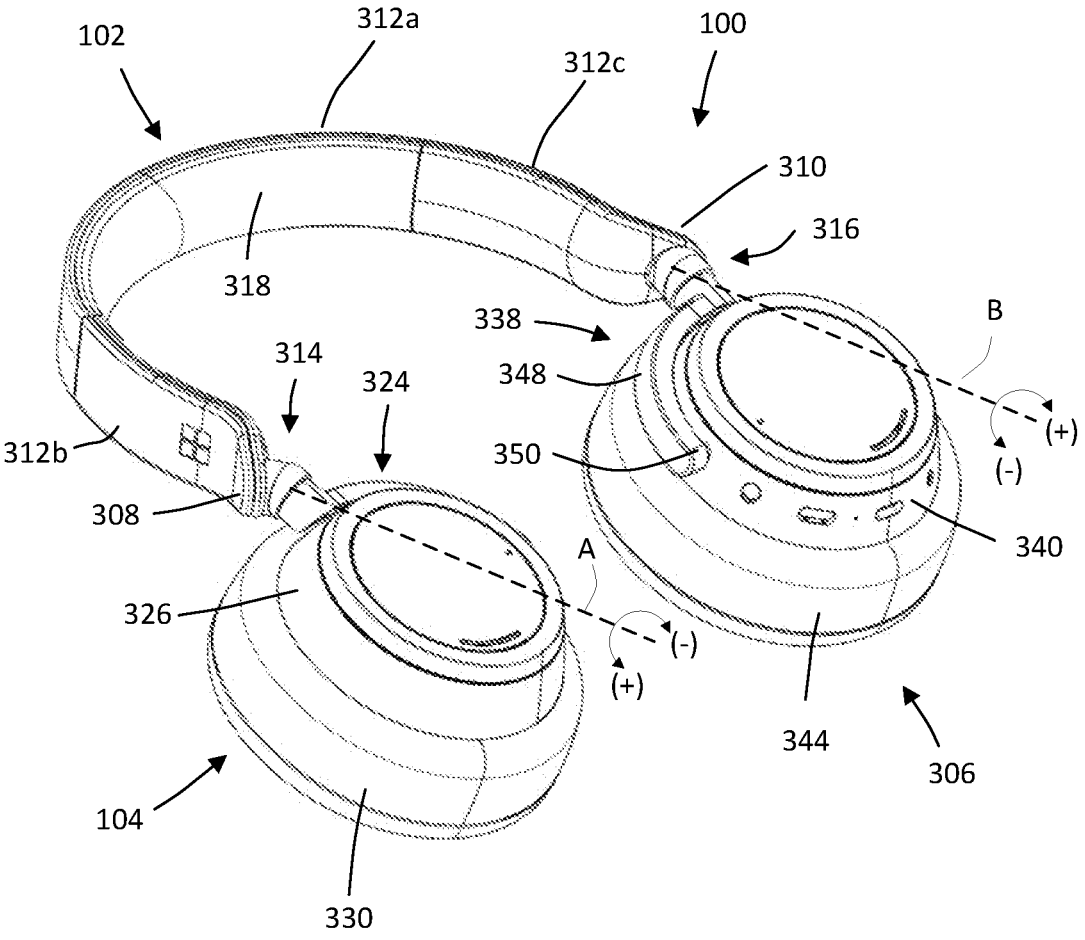
FIG. 5 is a front perspective view of an example headphone device in a storage configuration in accordance with an embodiment.
Figure 6:
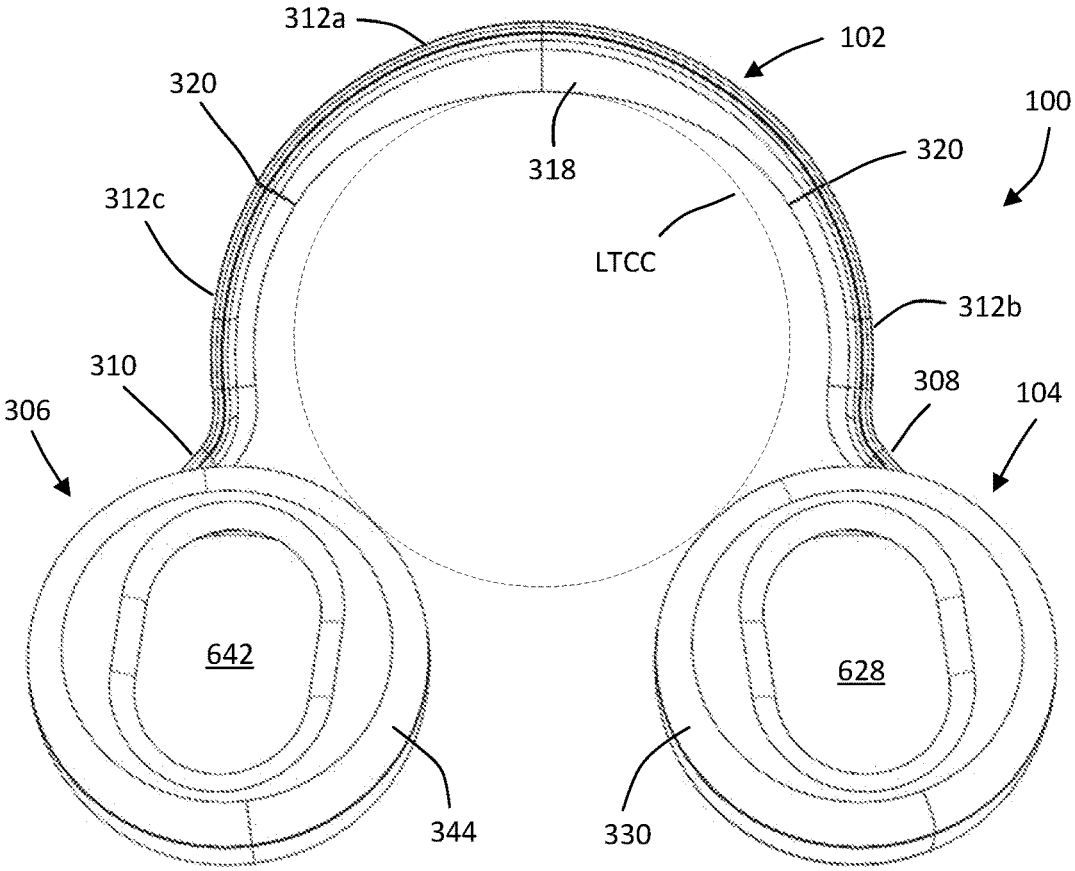
FIG. 6 is a rear view of the example headphone device of FIG. 5 in the storage configuration in accordance with an embodiment.

The second earcup 306 is rotatably coupled to the headband 102 about the second storage axis B so that the second earcup 306 can be rotated between a second listening orientation, shown in FIG. 3, and a second storage orientation, shown in FIGS. 5 and 6. The second earcup 306 can be coupled to the headband 102 so that the second earcup 306 can be rotated over any span. In an example embodiment, the second earcup 306 can rotate relative to the headband 102 in a span extending only between the second listening orientation and the second storage orientation, such as over a span of about 90°. In another example embodiment, the second earcup 306 can rotate relative to the headband 102 in a span up to 180°. In another example embodiment, the second earcup 306 can rotate relative to the headband 102 over a span that is greater than 180°. The second earcup 306 is constructed from a second yoke 338, a second earcup housing 340, a second speaker 642 (shown in FIG. 6), and a second earpad 344.

Similar to the first yoke 324, the second yoke 338 provides a linkage between the headband 102 and the second earcup housing 340. The second yoke 338 is rotatably coupled to the headband 102 at the second coupling 316 of the headband 102 and to the second earcup housing 340 at a second housing coupling 350. The second yoke 338 is rotatably coupled to the headband 102 about the second storage axis B and configured to position the second earcup 306 in the second listening orientation and in the second storage orientation based on the rotational position of the second yoke 338 relative to the headband 102. The second yoke 338 comprises a second coupling interface 346, a second yoke body 348, and the second housing coupling 350. The second yoke 338 defines a second yoke axis E, which is a projection of a longitudinal axis of the first yoke 324 that intersects the second storage axis B at the second coupling interface 346 and extends to the second housing coupling 350 onto the XY plane. The second yoke body 348 extends between the second coupling interface 346 and the second housing coupling 350 and may have any shape. In another example embodiment, the first yoke 324 can be configured to couple to the first earcup housing 326 at a plurality of spaced locations on the first earcup housing 326. In an example embodiment, the second yoke body 348 is an accurate member that curves around a portion of the second earcup housing 340. In an example embodiment, the second yoke 338 is rotatably coupled to the second earcup housing 340 at the second housing coupling 350 so that second earcup 306 can be tilted to match the angle of the side of the user's head above and below the user's ear. In another example embodiment, the second yoke body 348 can be integrated into the second earcup housing 340.

The second earcup housing 340 provides a framework for supporting the components of the second earcup 306 such as the second speaker 642 and the second earpad 344. The second earcup housing 340 can also define a cavity to house electronics for the headphone device 100. Still further, the second earcup housing 340 can support control features that provide an interface for a user to alter settings of the headphone device 100. The control features can include buttons, switches, knobs, and/or any other control. Still further, the second earcup housing 340 can support indicator features, such as indicator lights and/or display screens, that provide visual feedback that is related a feature and/or a status of the headphone device 100. Additionally, the second earcup housing 340 includes a surface opposite the earpad 330 that can be used for controls features and/or as a support or mounting surface, and the surface can be planar.

The second speaker 642 is mounted in the second earcup housing 340 and is configured to generate an audible signal that is projected out of the second earcup 306. The second speaker 642 can be configured to receive a digital, or analog, audio input which the second speaker 642 then converts into the audible signal. In an example embodiment, the second speaker 642 includes a plurality of speakers that provide different audible signals and/or that direct audible signals in different directions.

The second earpad 344 is generally interposed between the second earcup housing 340 and a user's head when the headphone device 100 is worn in the listening configuration. The second earpad 344 is configured to provide both user comfort, such as by providing cushioning, and a seal that is selected to reduce ambient noise heard by the user. The second earpad 344 is coupled to the second earcup housing 340 and provides a contact surface of the second earcup 306. A second earcup axis F extends across the contact surface of the second earcup 306 from an end of the second earcup 306 adjacent the headband 102 to an end of the second earcup 306 spaced away from the headband 102. In relation to the user, when the user wears the headphone device 100 in the listening configuration, the second earcup axis F is oriented parallel to the side of the user's head in a direction from above the user's ear to below the user's ear. The earcup axis is angled relative to the center Y-axis by an earcup axis tilt angle θ. In an example embodiment, the second earcup axis F is angled relative to the center Y-axis by an earcup axis tilt angle θ that is in a range between 10° and 50°. In another example embodiment, the second earcup axis F is angled relative to the center Y-axis by an earcup axis tilt angle θ that is in a range between 20° and 40°.

The second earpad 344 can be an annular member that defines an opening that permits the second speaker 642 to project sound to a user's ear when the headphone device 100 is in the listening configuration and worn over the ears of the user. In an example embodiment, the opening defined by the second earpad 344 is large enough to fit the user's ear so that the earpad surrounds the user's ear. In an example embodiment, the second earpad 344 is removably coupled to the second earcup housing 340 so that the second earpad 344 can be replaced by the user.

As described above, the headphone device 100 can be transformed between the listening configuration and the storage configuration. The storage configuration of the headphone device 100 will be described with reference to FIGS. 5-7, which illustrate different views of the headphone device 100 in the storage configuration in accordance with embodiments. The headphone device 100 is converted from the listening configuration to the storage configuration by rotating the earcups 104 and 306 relative to the headband 102 about the respective storage axis in a range between −90° and 90°, where negative (−) angles indicate rotation of the earcups 104 and 306 so that the respective speakers are directed toward the user's body and positive (+) angles indicate rotation of the earcups 104 and 306 so that the respective speakers are directed away from the user's body. Additionally, it should be appreciated that during the conversion between the listening configuration and the storage configuration, the earcups can be rotated in opposite directions so that they are both directed toward or away from the user. In an embodiment, the first storage orientation of the first earcup 104 corresponds to rotation of the first earcup 104 about the first storage axis A from the first listening orientation in a range between −70° and −90°. In another embodiment, the first storage orientation of the first earcup 104 corresponds to rotation of the first earcup 104 about the first storage axis A from the first listening orientation in a range between 70° and 90°. In an embodiment, the second storage orientation of the second earcup 306 corresponds to rotation of the second earcup 306 about the second storage axis B from the first listening orientation in a range between −70° and −90°. In an embodiment, the second storage orientation of the second earcup 306 corresponds to rotation of the second earcup 306 about the second storage axis B from the second listening orientation in a range between −70° and −90°.

As described above, in the storage configuration the headphone device 100 can be positioned so that the headband 102 extends around the user's neck and the earcups 104 and 306 are spaced to provide a clearance around the user's neck. The relationship between the storage axes and the yoke axes is configured so that as the earcups are rotated from the listening orientation to the storage orientation, the earcups are both rotated and moved laterally outward away from each other. In an example embodiment, that motion is achieved by constructing each yoke to define a respective yoke axis having a yoke tilt angle δ relative to the respective storage axis. In an example embodiment, the yoke is constructed so that the yoke axis intersects the respective storage axis at the interface between the yoke and the headband 102, which results in the respective earcup tracing a generally conical path during rotation. For example, the first earcup 104 comprises the first yoke 324 that defines the first yoke axis C, and the first yoke axis C is angled relative to the first storage axis A by the yoke tilt angle δ, as shown in FIG. 3. Similarly, the second earcup 306 comprises the second yoke 338 that defines the second yoke axis E, and the second yoke axis E is angled relative to the second storage axis B by the yoke tilt angle δ. In an example embodiment, the yoke tilt angle δ between the first storage axis A and the first yoke axis C is in a range between 10° and 50°. In another example embodiment, the yoke tilt angle δ between the first storage axis A and the first yoke axis C is in a range between 20° and 40°. In an example embodiment, the yoke tilt angle δ between the second storage axis B and the second yoke axis E is in a range between 10° and 50°. In another example embodiment, the yoke tilt angle δ between the second storage axis B and the second yoke axis E is in a range between 20° and 40°.

The clearance provided for a user's neck can be defined by a largest tangent clearance cylinder ("LTCC"), which approximates the shape and size of a user's neck. The largest tangent clearance cylinder is a cylindrical space bound by the headband 102, the first earcup 104, and the second earcup 306 when each of the earcups is in the respective storage orientation. The storage orientation corresponds to rotation of the respective earcup relative to the headband in a range between −90° and 90° from the listening orientation. The largest tangent clearance cylinder corresponds to the cylindrical space sized so that an outer boundary of the cylindrical space is tangent to the innermost locations of the headband 102, the first earcup 104, and the second earcup 306, when each of the earcups is in the respective storage orientation. The headphone device 100 may be configured so that in the storage configuration, the largest tangent clearance cylinder has a predefined diameter. In an example embodiment, the largest tangent clearance cylinder has a diameter of at least 4.75 inches (120.7 mm). In another example embodiment, the largest tangent clearance cylinder has a diameter of at least 5.00 inches (127.0 mm). In another example embodiment, the largest tangent clearance cylinder has a diameter of at least 5.25 inches (133.4 mm).

Figure 7:
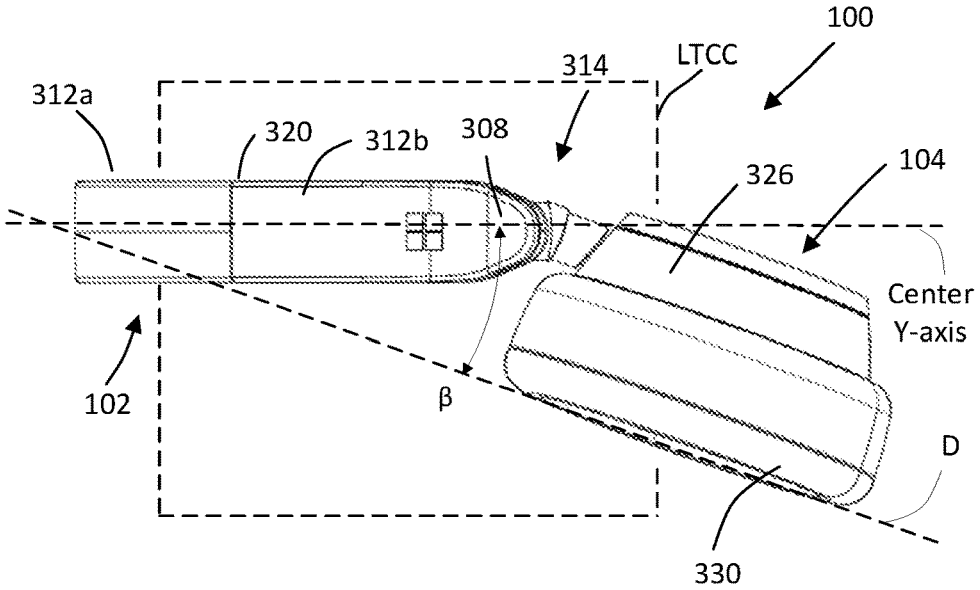
FIG. 7 is a side view of the example headphone device of FIG. 5 in the storage configuration in accordance with an embodiment.

In the storage configuration, the earcups 104 and 306 can be angled downward toward the user's chest. The downward angle can be configured to provide clearance for the user to move their head, i.e., clearance for movement of the user's chin, and in some example embodiments to provide protection for speaker components included in the earcups, e.g., by locating the opening of the earpads against the user's chest. For example, an earcup in the storage orientation can be configured so that an angle between the center Y-axis and a projection of the respective earcup axis on the YZ plane forms a storage angle β as shown in FIG. 7, and the storage angle β can be selected to approximately match an angle between the top of a user's shoulders and the user's chest. In an example embodiment, when the first earcup 104 is in the storage orientation the storage angle β between the center Y-axis and a projection of the first earcup axis D is in a range between 20° and 80°. In another example embodiment, when the first earcup 104 is in the storage orientation the storage angle β between the center Y-axis and a projection of the first earcup axis D is in a range between 40° and 60°. In an example embodiment, when the second earcup 306 is in the storage orientation the storage angle β between the center Y-axis and a projection of the second earcup axis F is in a range between 20° and 80°. In another example embodiment, when the second earcup 306 is in the storage orientation the storage angle β between the center Y-axis and a projection of the second earcup axis F is in a range between 40° and 60°.

III. Further Discussion of Some Example Embodiments

A first example headphone device comprises a headband, a first earcup, and a second earcup. The first earcup is rotatably coupled to the headband about a first storage axis. The first earcup is rotatable between a first listening orientation and a first storage orientation. The first storage orientation corresponds to an orientation of the first earcup rotated about the first storage axis that is in a range between −90° and 90° from the first listening orientation. The second earcup is rotatably coupled to the headband about a second storage axis. The second earcup is rotatable between a second listening orientation and a second storage orientation. The second storage orientation corresponds to an orientation of the second earcup rotated about the second storage axis that is in a range of between −90° and 90° from the second listening orientation. A largest tangent clearance cylinder having a diameter of at least 4.75 inches is defined by the headband, the first earcup and the second earcup when the first earcup is in the first storage orientation and when the second earcup is in the second storage orientation.

In a first aspect of the first example headphone device, the largest projected tangent clearance cylinder has a diameter of at least 5.00 inches.

In an implementation of the first aspect of the first example headphone device, the largest projected tangent clearance cylinder has a diameter of at least 5.25 inches.

In a second aspect of the first example headphone device, the first storage axis and the second storage axis define an XY plane, a center Y-axis is in the XY plane and interposed between the first earcup and the second earcup, and a YZ plane is perpendicular to the XY plane and includes the center Y-axis. A first earcup axis extends across a contact surface of the first earcup from an end of the first earcup adjacent the headband to an end of the first earcup spaced away from the headband. A storage angle β between the center Y-axis on the YZ plane and a projection of the first earcup axis on the YZ plane when the first earcup is in the first storage orientation is in a range between 20° and 80°. The second aspect of the first example headphone device can be implemented in combination with the first aspect of the first example headphone device, though the example embodiments are not limited in this respect.

In a first implementation of the second aspect of the first example headphone device, the storage angle β is in a range between 40° and 60°.

In a second implementation of the second aspect of the first example headphone device, a second earcup axis extends across a contact surface of the second earcup from an end of the second earcup adjacent the headband to an end of the second earcup spaced away from the headband, and the storage angle β between the center Y-axis on the YZ plane and a projection of the second earcup axis on the YZ plane when the second earcup is in the second storage orientation is in a range between 20° and 80°.

In a third aspect of the first example headphone device, the first storage orientation corresponds to an orientation of the first earcup about the first storage axis that is in a range between −70° and −90° from the first listening orientation, and the second storage orientation corresponds to an orientation of the second earcup about the second storage axis that is in a range between −70° and −90° from the second listening orientation. The third aspect of the first example headphone device can be implemented in combination with the first and/or second aspect of the first example headphone device, though the example embodiments are not limited in this respect.

In a fourth aspect of the first example headphone device, the first storage orientation corresponds to an orientation of the first earcup about the first storage axis that is in a range of between 70° and 90° from the first listening orientation, and the second storage orientation corresponds to an orientation of the second earcup about the second storage axis that is in a range of between 70° and 90° from the second listening orientation. The fourth aspect of the first example headphone device can be implemented in combination with the first, second and/or third aspect of the first example headphone device, though the example embodiments are not limited in this respect.

In a fifth aspect of the first example headphone device, the first earcup is rotatable relative to the headband over a span that is greater than 180°, and the second earcup is rotatable relative to the headband over a span that is greater than 180°. The fifth aspect of the first example headphone device can be implemented in combination with the first, second, third and/or fourth aspect of the first example headphone device, though the example embodiments are not limited in this respect.

A second example headphone device comprises a headband, a first earcup, and a second earcup. The first earcup is rotatably coupled to the headband and configured to rotate about a first storage axis between a first listening orientation and a first storage orientation. The first storage orientation of the first earcup corresponds to rotation of the first earcup about the first storage axis in a range between −90° and 90° from the first listening orientation. The second earcup is rotatably coupled to the headband and configured to rotate about a second storage axis between a second listening orientation and a second storage orientation. The second storage orientation of the second earcup corresponds to rotation of the second earcup about the second storage axis in a range between −90° and 90° from the second listening orientation. The first storage axis and the second storage axis define an XY plane, a center Y-axis is in the XY plane and interposed between the first earcup and the second earcup, and a YZ plane is perpendicular to the XY plane and includes the center Y-axis. A first earcup axis extends across a contact surface of the first earcup from an end of the first earcup adjacent the headband to an end of the first earcup spaced away from the headband. A second earcup axis extends across a contact surface of the second earcup from an end of the second earcup adjacent the headband to an end of the second earcup spaced away from the headband. A storage angle β between the center Y-axis on the YZ plane and a projection of the first earcup axis on the YZ plane when the first earcup is in the first storage orientation is in a range between 20° and 80°.

In a first aspect of the second example headphone device, the storage angle β is in a range between 40° and 60°.

In a second aspect of the second example headphone device, the first storage orientation corresponds to an orientation of the first earcup about the first storage axis that is in a range between −70° and −90° from the first listening orientation, and the second storage orientation corresponds to an orientation of the second earcup about the second storage axis that is in a range between −70° and −90° from the second listening orientation. The second aspect of the second example headphone device can be implemented in combination with the first aspect of the second example headphone device, though the example embodiments are not limited in this respect.

In a third aspect of the second example headphone device, the first storage orientation corresponds to an orientation of the first earcup about the first storage axis that is in a range between 70° and 90° from the first listening orientation, and the second storage orientation corresponds to an orientation of the second earcup about the second storage axis that is in a range between 70° and 90° from the second listening orientation. The third aspect of the second example headphone device can be implemented in combination with the first and/or second aspect of the second example headphone device, though the example embodiments are not limited in this respect.

In a fourth aspect of the second example headphone device, the first earcup is rotatable relative to the headband over a span that is greater than 180°, and the second earcup is rotatable relative to the headband over a span that is greater than 180°. The fourth aspect of the second example headphone device can be implemented in combination with the first, second and/or third aspect of the second example headphone device, though the example embodiments are not limited in this respect.

A third example headphone device comprises a headband, a first earcup, and a second earcup. The first earcup comprises a first yoke rotatably coupled to the headband at a first interface and configured to rotate around a first storage axis. The first yoke defines a first yoke axis. The second earcup comprises a second yoke rotatably coupled to the headband and configured to rotate about a second storage axis. The second yoke defines a second yoke axis. The first storage axis and the second storage axis define an XY plane. The third example headphone device defines a center Y-axis in the XY plane that is interposed between the first earcup and the second earcup. The first yoke axis is defined by a projection of a longitudinal axis of the first yoke onto the XY plane. The second yoke axis is defined by a projection of a longitudinal axis of the second yoke onto the XY plane. A yoke tilt angle $\delta$ between the first storage axis and the first yoke axis is in a range between 10° and 50°, and a yoke tilt angle $\delta$ between the second storage axis and the second yoke axis is in a range between 10° and 50°. A storage axis tilt angle $\alpha$ between the center Y-axis and the first storage axis is in a range between 0° and 20°, and a storage axis tilt angle $\alpha$ between the center Y-axis and the second storage axis is in a range between 0° and 20°.

In a first aspect of the third example headphone device, the yoke axis tilt angle $\delta$ between the first storage axis and the first yoke axis is in a range between 20° and 40°, and the yoke axis tilt angle $\delta$ between the second storage axis and the second yoke axis is in a range between 20° and 40°.

In a second aspect of the third example headphone device, the first earcup further comprises a first earcup housing rotatably coupled to the first yoke, and the second earcup further comprises a second earcup housing rotatably coupled to the second yoke. The second aspect of the third example headphone device can be implemented in combination with the first aspect of the third example headphone device, though the example embodiments are not limited in this respect.

In an implementation of the second aspect of the third example headphone device, the first earcup comprises a first earpad coupled to the first earcup housing, and the first earpad defines a contact surface of the first earcup. A first earcup axis extends across the contact surface of the first earcup from an end of the first earcup adjacent the headband to an end of the first earcup spaced away from the headband. The second earcup comprises a second earpad coupled to the second earcup housing, and the second earpad defines a contact surface of the second earcup. A second earcup axis extends across the contact surface of the second earcup from an end of the second earcup adjacent the headband to an end of the second earcup spaced away from the headband. An earcup axis tilt angle $\theta$ between the center Y-axis and the first earcup axis is in a range between 10° and 50°, and an earcup axis tilt angle $\theta$ between the center Y-axis and the second earcup axis is in a range between 10° and 50°.

In an example of the implementation, the earcup axis tilt angle $\theta$ between the center Y-axis and the first earcup axis is in a range between 20° and 40°, and the earcup axis tilt angle $\theta$ between the center Y-axis and the second earcup axis is in a range between 20° and 40°.

In a third aspect of the third example headphone device, the storage axis tilt angle $\alpha$ between the center Y-axis and the first storage axis is in a range between 0° and 10°, and the storage axis tilt angle $\alpha$ between the center Y-axis and the second storage axis is in a range between 0° and 10°. The third aspect of the third example headphone device can be implemented in combination with the first and/or second aspect of the third example headphone device, though the example embodiments are not limited in this respect.

IV. Conclusion

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

What is claimed is:

1. A headphone device, comprising:

a headband;

a first earcup rotatably coupled to the headband about a first storage axis, wherein the first earcup is rotatable between a first listening orientation and a first storage orientation, wherein the first storage orientation corresponds to an orientation of the first earcup rotated about the first storage axis that is in a range between −90° and 90° from the first listening orientation; and a second earcup rotatably coupled to the headband about a second storage axis, wherein the second earcup is rotatable between a second listening orientation and a second storage orientation, wherein the second storage orientation corresponds to an orientation of the second earcup rotated about the second storage axis that is in a range of between −90° and 90° from the second listening orientation, and wherein a largest tangent clearance cylinder having a diameter of at least 4.75 inches is defined by the headband, the first earcup and the second earcup when the first and second earcups are in the respective first and second storage orientations in which the first and second earcups do not exert a force on sides of a head of a user laterally inward toward a YZ plane defined between the first and second earcups.

2. The headphone device of claim 1, wherein the largest projected tangent clearance cylinder has a diameter of at least 5.00 inches.

3. The headphone device of claim 2, wherein the largest projected tangent clearance cylinder has a diameter of at least 5.25 inches.

4. The headphone device of claim 1, wherein the first storage axis and the second storage axis define an XY plane, a center Y-axis is in the XY plane and interposed between the first earcup and the second earcup, and a YZ plane is perpendicular to the XY plane and includes the center Y-axis, wherein a first earcup axis extends across a contact surface of the first earcup from an end of the first earcup adjacent the headband to an end of the first earcup spaced away from the headband, and wherein a storage angle $\beta$ between the center Y-axis on the YZ plane and a projection of the first earcup axis on the YZ plane when the first earcup is in the first storage orientation is in a range between 20° and 80°.

5. The headphone device of claim 4, wherein the storage angle β is in a range between 40° and 60°.

6. The headphone device of claim 4, wherein a second earcup axis extends across a contact surface of the second earcup from an end of the second earcup adjacent the headband to an end of the second earcup spaced away from the headband, and wherein the storage angle β between the center Y-axis on the YZ plane and a projection of the second earcup axis on the YZ plane when the second earcup is in the second storage orientation is in a range between 20° and 80°.

7. The headphone device of claim 1, wherein the first storage orientation corresponds to an orientation of the first earcup about the first storage axis that is in a range between −70° and −90° from the first listening orientation, and wherein the second storage orientation corresponds to an orientation of the second earcup about the second storage axis that is in a range between −70° and −90° from the second listening orientation.

8. The headphone device of claim 1, wherein the first storage orientation corresponds to an orientation of the first earcup about the first storage axis that is in a range of between 70° and 90° from the first listening orientation, and wherein the second storage orientation corresponds to an orientation of the second earcup about the second storage axis that is in a range of between 70° and 90° from the second listening orientation.

9. The headphone device of claim 1, wherein the first earcup is rotatable relative to the headband over a span that is greater than 180°, and wherein the second earcup is rotatable relative to the headband over a span that is greater than 180°.

10. A headphone device, comprising:

a headband;

a first earcup rotatably coupled to the headband and configured to rotate about a first storage axis between a first listening orientation and a first storage orientation, the first storage orientation of the first earcup corresponding to rotation of the first earcup about the first storage axis in a range between −90° and 90° from the first listening orientation; and a second earcup rotatably coupled to the headband and configured to rotate about a second storage axis between a second listening orientation and a second storage orientation, the second storage orientation of the second earcup corresponding to rotation of the second earcup about the second storage axis in a range between −90° and 90° from the second listening orientation, wherein the first storage axis and the second storage axis define an XY plane, wherein a center Y-axis is in the XY plane and interposed between the first earcup and the second earcup, wherein a YZ plane is perpendicular to the XY plane and includes the center Y-axis, wherein a first earcup axis extends across a contact surface of the first earcup from an end of the first earcup adjacent the headband to an end of the first earcup spaced away from the headband, wherein a second earcup axis extends across a contact surface of the second earcup from an end of the second earcup adjacent the headband to an end of the second earcup spaced away from the headband, and wherein a storage angle β between the center Y-axis on the YZ plane and a projection of the first earcup axis on the YZ plane when the first earcup is in the first storage orientation is in a range between 20° and 80°, wherein the end of the first earcup adjacent the headband is between an origin of the storage angle β and the end of the first earcup spaced away from the headband.

11. The headphone device of claim 10, wherein the storage angle β is in a range between 40° and 60°.

12. The headphone device of claim 10, wherein the first storage orientation corresponds to an orientation of the first earcup about the first storage axis that is in a range between −70° and −90° from the first listening orientation, and wherein the second storage orientation corresponds to an orientation of the second earcup about the second storage axis that is in a range between −70° and −90° from the second listening orientation.

13. The headphone device of claim 10, wherein the first storage orientation corresponds to an orientation of the first earcup about the first storage axis that is in a range between 70° and 90° from the first listening orientation, and wherein the second storage orientation corresponds to an orientation of the second earcup about the second storage axis that is in a range between 70° and 90° from the second listening orientation.

14. The headphone device of claim 10, wherein the first earcup is rotatable relative to the headband over a span that is greater than 180°, and wherein the second earcup is rotatable relative to the headband over a span that is greater than 180°.

15. A headphone device, comprising:

a headband;

a first earcup comprising a first yoke, the first yoke being rotatably coupled to the headband at a first interface and configured to rotate around a first storage axis, the first yoke defining a first yoke axis; and a second earcup comprising a second yoke, the second yoke being rotatably coupled to the headband and configured to rotate about a second storage axis, the second yoke defining a second yoke axis, wherein the first storage axis and the second storage axis define an XY plane, wherein the headphone device defines a center Y-axis in the XY plane that is interposed between the first earcup and the second earcup, wherein the first yoke axis is defined by a projection of a longitudinal axis of the first yoke onto the XY plane, wherein the second yoke axis is defined by a projection of a longitudinal axis of the second yoke onto the XY plane, wherein a yoke tilt angle β between the first storage axis and the first yoke axis is in a range between 20° and 40°, wherein a yoke tilt angle β between the second storage axis and the second yoke axis is in a range between 20° and 40°, wherein a storage axis tilt angle α between the center Y-axis and the first storage axis is in a range between 0° and 20°, and wherein a storage axis tilt angle α between the center Y-axis and the second storage axis is in a range between 0° and 20°.

16. The headphone device of claim 15, wherein the first earcup further comprises a first earcup housing rotatably coupled to the first yoke, and wherein the second earcup further comprises a second earcup housing rotatably coupled to the second yoke.

17. The headphone device of claim 16, wherein the first earcup comprises a first earpad coupled to the first earcup housing, wherein the first earpad defines a contact surface of the first earcup, wherein a first earcup axis extends across the contact surface of the first earcup from an end of the first earcup adjacent the headband to an end of the first earcup spaced away from the headband, wherein the second earcup comprises a second earpad coupled to the second earcup housing, wherein the second earpad defines a contact surface of the second earcup, wherein a second earcup axis extends across the contact surface of the second earcup from an end of the second earcup adjacent the headband to an end of the second earcup spaced away from the headband, wherein an earcup axis tilt angle θ between the center Y-axis and the first earcup axis is in a range between 10° and 50°, and wherein an earcup axis tilt angle θ between the center Y-axis and the second earcup axis is in a range between 10° and 50°.

18. The headphone device of claim 17, wherein the earcup axis tilt angle θ between the center Y-axis and the first earcup axis is in a range between 20° and 40°, and wherein the earcup axis tilt angle θ between the center Y-axis and the second earcup axis is in a range between 20° and 40°.

19. The headphone device of claim 15, wherein the storage axis tilt angle α between the center Y-axis and the first storage axis is in a range between 0° and 10°, and wherein the storage axis tilt angle α between the center Y-axis and the second storage axis is in a range between 0° and 10°.

20. The headphone device of claim 15, wherein a largest tangent clearance cylinder having a diameter of at least 4.75 inches is defined by the headband, the first earcup and the second earcup when the first and second earcups are in respective first and second storage orientations in which the first and second earcups do not exert a force on sides of a head of a user laterally inward toward a YZ plane that is defined between the first and second earcups and that is perpendicular to the XY plane.

* * * * *